US005859889A

United States Patent [19]

Long

[11] Patent Number: 5,859,889

[45] Date of Patent: Jan. 12, 1999

[54] SETTING-UP SHEET COUNTERS

[75] Inventor: David Brian Long, Manningtree, Great Britain

[73] Assignee: Pelcombe Limited, United Kingdom

[21] Appl. No.: 894,968

[22] PCT Filed: Mar. 1, 1996

[86] PCT No.: PCT/GB96/00454

§ 371 Date: Sep. 3, 1997

§ 102(e) Date: Sep. 3, 1997

[87] PCT Pub. No.: WO96/27856

PCT Pub. Date: Sep. 12, 1996

[30] Foreign Application Priority Data

Mar. 3, 1995 [GB] United Kingdom ..... 95 04357.6

[51] Int. Cl.[6] ..... G06M 7/00

[52] U.S. Cl. ..... 377/8

[58] Field of Search ..... 377/8

[56] References Cited

U.S. PATENT DOCUMENTS 5,454,017 9/1995 Price et al. ..... 377/8

5,612,984 3/1997 Fuller et al. ..... 377/8

FOREIGN PATENT DOCUMENTS 616300 9/1994 European Pat. Off. .

05094569 8/1993 Japan .

2238895 6/1991 United Kingdom .

*Primary Examiner*—Margaret Rose Wambach

*Attorney, Agent, or Firm*—Andrus, Sceales, Starke & Sawall

[57] ABSTRACT

A sheet counter has an elongate element (18) in which is formed a suction port (19), connected to a vacuum source by a duct (26). A pressure sensor is arranged to sense the pressure in the duct, in the vicinity of the port (19), and produces an electrical signal indicative thereof. The counter is set up by sensing the pressure in the duct with the port (19) open, either with the vacuum source operating or before operation thereof, and then by sensing the pressure in the duct with the port closed and the vacuum source operating. A pressure count-value part-way between the two sensed pressures is computed and during subsequent operation of the counter, a valid count signal is generated only if the instantaneous sensed pressure in the duct falls below the computed count-value.

10 Claims, 3 Drawing Sheets

SETTING-UP SHEET COUNTERS

This invention relates to a method of setting-up a sheet counter, intended in particular—but not exclusively—for counting sheets of paper.

A known form of sheet counter, primarily intended for counting sheets of paper such as bank-notes, has an elongate element which is inserted into the corner region of a stack of paper sheets, the element having on one side a port which is connected back to a low (sub-atmospheric) pressure source. An elongate member having its axis substantially parallel to that of the element orbits around the latter and serves to transfer the corner regions of sheets, one at a time, from one side of the element to the other. The corner region of the next-to-be-counted sheet of paper in the stack is lifted from the stack by air drawn through the port until that sheet rests on that element and closes off the port. The element is moved through an acute angle to open a gap for the elongate member, orbiting round the element, to pass between that sheet and the remainder of the stack and then to transfer that sheet to the other side of the element.

A pressure sensor is disposed to sense the pressure in the duct leading to the port, as close as possible to that port in order to allow the generation of a count signal. Each time the port is closed off, the pressure in the duct falls significantly below atmospheric pressure, and that pressure fall is detected and used to produce a count signal. In order to reduce the likelihood of an erroneous count, often the count signal resulting from the sensing of the pressure is combined with a position signal, so that a valid count will be generated only if a pressure change is detected at the time a sheet should close the suction port.

Unfortunately, counting errors sometimes occur in sheet counters as described above, on account of significant pressure fluctuations which may arise in the low pressure source. Also, a significant change in atmospheric pressure can affect count reliability. This leads to a requirement to calibrate the equipment from time to time, and also when it is first installed, especially if the equipment is installed at some geographically elevated site.

In EP-A-0 616 300 there is described a sheet counter of a generally similar kind to that described above and which dynamically can adjust a counting threshold as a counting operation proceeds. Specifically, it suggests that the count threshold should be dynamically set as a proportion of a rolling average of a predetermined number of vacuum levels obtained on previous count cycles. This method has the disadvantage that a counting operation must be commenced before an accurate threshold can be set up, by which time there might already have been one or more miscounts.

It is an aim of the present invention to provide a method of setting-up a sheet counter having an element including a port through which air is drawn during operation of the counter, the port being closed by the sheets being counted, one at a time, which method allows greater counting reliability notwithstanding local variations in the operating conditions.

According to the present invention there is provided a method of setting-up a sheet counter before the commencement of a counting operation, which counter includes an element having a suction port over which the sheets to be counted are caused to lie in sequence one after another, a source of sub-atmospheric pressure connected by a duct to the port, and means to sense the pressure within the duct in the vicinity of the port which sensing means provides an electrical signal indicative of sensed pressure, in which method the port is left open and the pressure in the duct is sensed to obtain a first pressure, either before said source is operated to draw air through the port or after operation of said source has commenced; the source is operated and the port in the element is covered whereafter the pressure in the duct is sensed again to obtain a second pressure; and a count pressure value part-way between the first and second pressures is computed, a valid count signal in a subsequent counting operation being generated only if the instantaneous sensed pressure falls below the count pressure value.

In the setting-up method of this invention, a count pressure threshold is established, so that a count signal may reliably be generated whenever the suction port is closed off, and no count signal will be generated whenever the suction port is open. This arrangement isolates the counting of the sheets from variations in the pressure of the low pressure source (which is usually a vacuum pump), such as may be caused by the performance of the source, and also from variations in atmospheric pressure.

It will be appreciated that when performing the method of this invention, the first pressure may be sensed either with the low pressure source operating or before operation of the source has commenced. The currently-preferred technique is to commence operation of the source only after the first pressure sensing step has been completed, but as a matter of practice, both systems are possible and may be accommodated by a suitable adjustment in the subsequent computing step of the count pressure value.

It is preferred that pressure in the duct is sampled a predetermined number of times over a pre-set time period, both when the port is open and when the port is covered. Then, the average of the sampled pressures may be used, in each case, as the open (first) and covered (second) pressures for the computing of the count pressure value.

In a case where the low pressure source comprises a vacuum pump, it is the usual practice to insert a filter on the up-stream side of the pump, to protect the pump from paper dust or other detritus which may enter the port. Should that filter become significantly clogged, then the performance of the vacuum pump may fall to such an extent that a reliable count cannot be achieved. The method of the present invention thus preferably includes a step of checking the difference between the open (first) and covered (second) pressures, and indicating an error condition if that pressure difference is below a predetermined value. The error condition may serve to inhibit further operation of the counter.

The method of this invention may be performed on an automatic basis, immediately before the commencement of a counting operation, each time a counting operation is to be performed. It is thus convenient for the element having the port through which air is drawn to be positioned adjacent one end of a stack of sheets to be counted, but with the port still clear of that stack, so that the open pressure may be determined, the element then being moved into contact with the end sheet of the stack so as to cover the port, whereafter the covered pressure is determined. The sensing of the covered pressure may be inhibited for a pre-set period following the covering of the port, in order to allow the establishment of a substantially static covered pressure value.

Most conveniently, the method of this invention is performed by a micro-processor incorporated within the sheet counter, to fulfil the various functional requirements of that counter. In a case where the pressure sensor provides an analogue output indicative of sensed pressure, that output may be converted to a digital signal for appropriate processing within the micro-processor.

Preferably, the sheet counter is of the design described above, and so has an elongate element for insertion in the corner region of a stack of sheets to be counted, and an elongate member arranged to lie substantially parallel to said element and which member is arranged to orbit around the element. The element has the suction port in the side thereof to which sheets are drawn, before being transferred to the other side of that element by the orbiting member. A sensor for the position of the elongate member which orbits around the element may be provided, so as to give an output at the time a count signal may be expected, which output is combined with the output from the pressure sensor so as further to minimise the likelihood of an erroneous count.

By way of example only, one specific example of sheet counter setting-up method of this invention will now be described in detail, reference being made to the accompanying drawings in which.

Figure 1:
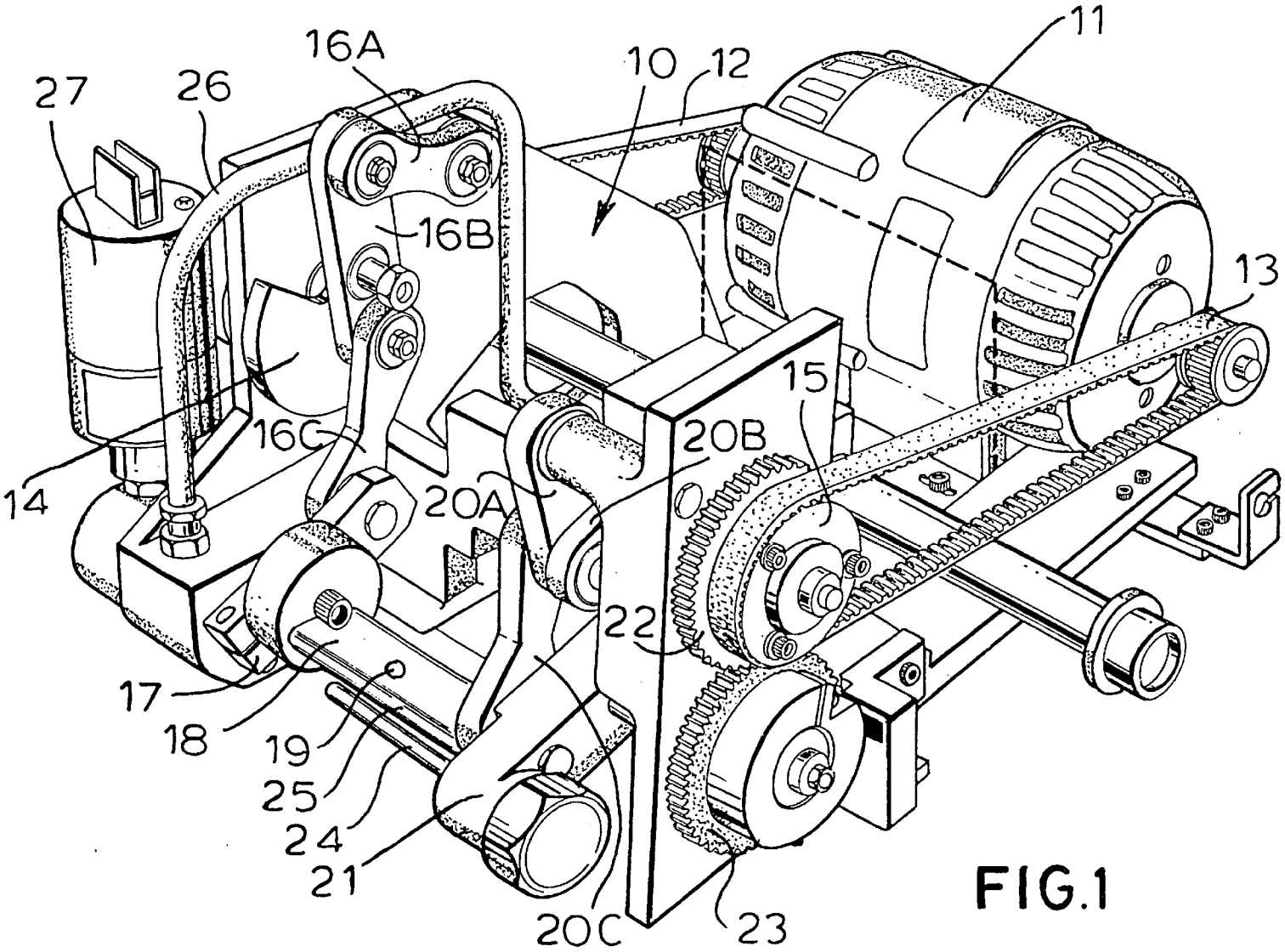
FIG. 1 is a perspective view of a known form of sheet counter, with which the example of this invention may be used.

FIG. 1 shows a known form of sheet counter comprising a frame 10 which supports an electric motor 11 drivingly connected by means of toothed belts 12 and 13 to two cranks arranged one on each side of the frame, respectively. In FIG. 1 only one crank 14 can be seen; the second crank is similar and mounted on the same shaft as pulley 15 driven by belt 13. Crank 14 is connected by a complex linkage 16A, 16B, 16C to a pivoted arm 17 which supports an elongate element in the form of a blade 18, in which is provided a suction port 19. The second crank is connected by a further complex linkage 20A, 20B, 20C to another arm 21 which is itself mounted on a third crank (not shown) driven by pulley 15 through meshing gears 22 and 23. Arm 21 carries an elongate member in the form of a rotatable pin 24 the axis of which is parallel to that of the blade 18. The mounting of the pin 24 in arm 21 allows the pin freely to rotate about its axis.

Figure 2:
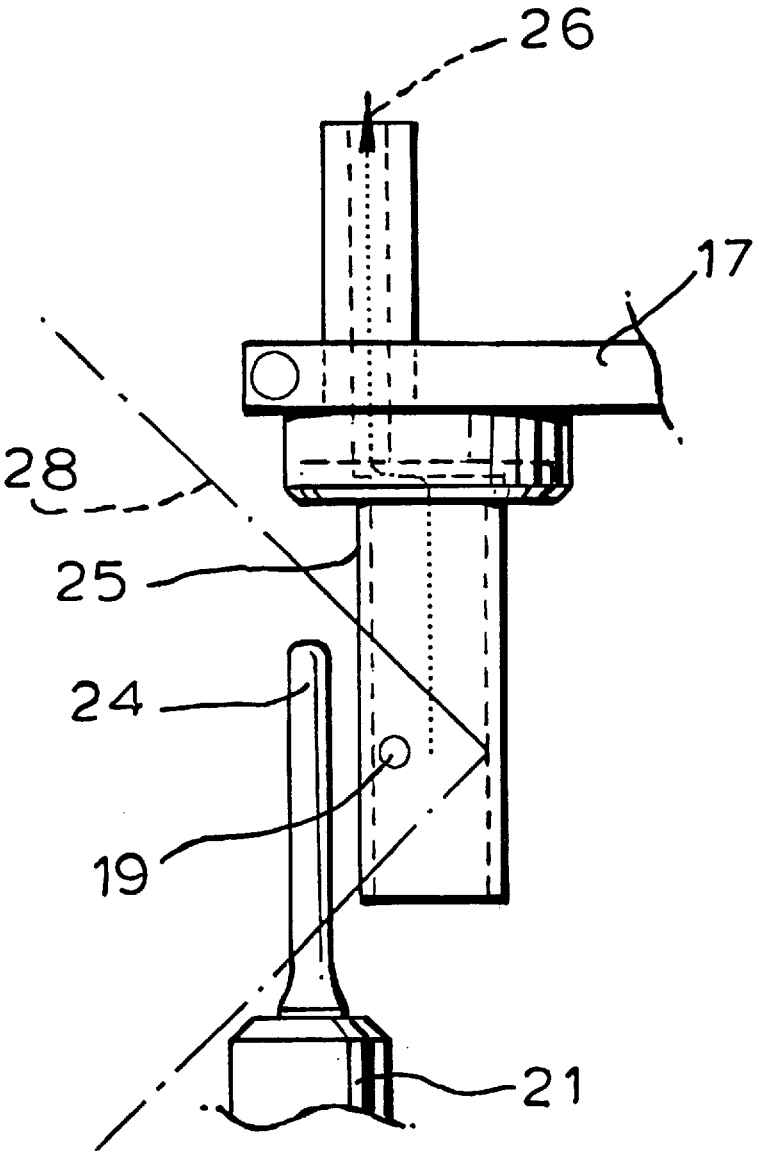
FIG. 2 is a part view of the sheet counter of FIG. 1.

The arrangement described above is such that the blade 18 performs an essentially rocking movement approximately based on its leading edge 25, while the pin 24 orbits around that blade. Sheets in a stack are counted by having the blade 18 lying across the corner region of the stack and then transferring the sheets one at a time from one side of the blade to the other, by the orbiting action of pin 24 in conjunction with the rocking action of the blade 18. The next sheet to be counted is drawn on to the blade 18 by suction applied to port 19, through pipe 26 connected back to a low pressure source, such as a vacuum pump. One such sheet is shown in FIG. 2 at 28.

The above-described known sheet counter is modified to allow the performance of the setting-up method of this invention. A pressure sensor 27 is arranged to sense the pressure in a duct (not shown) within the frame 10, which connects port 19 to pipe 26. The sensor 27 provides an analogue electrical signal indicative of the instantaneous detected pressure.

The modified counter includes a micro-processor to control the operation of the counter and to provide various required outputs and indications to an operator. That micro-processor may also be programmed to perform the setting-up method, on an automatic basis, each time a counting operation is to be performed. The micro-processor may include an internal analogue-to-digital converter which directly receives the analogue signal from the pressure sensor 27, or the analogue signal from the sensor 27 may be provided to a separate analogue-to-digital converter, the output of which is supplied to the micro-processor. Either way, the subsequent processing of the sensed pressures is performed digitally.

Figure 3:
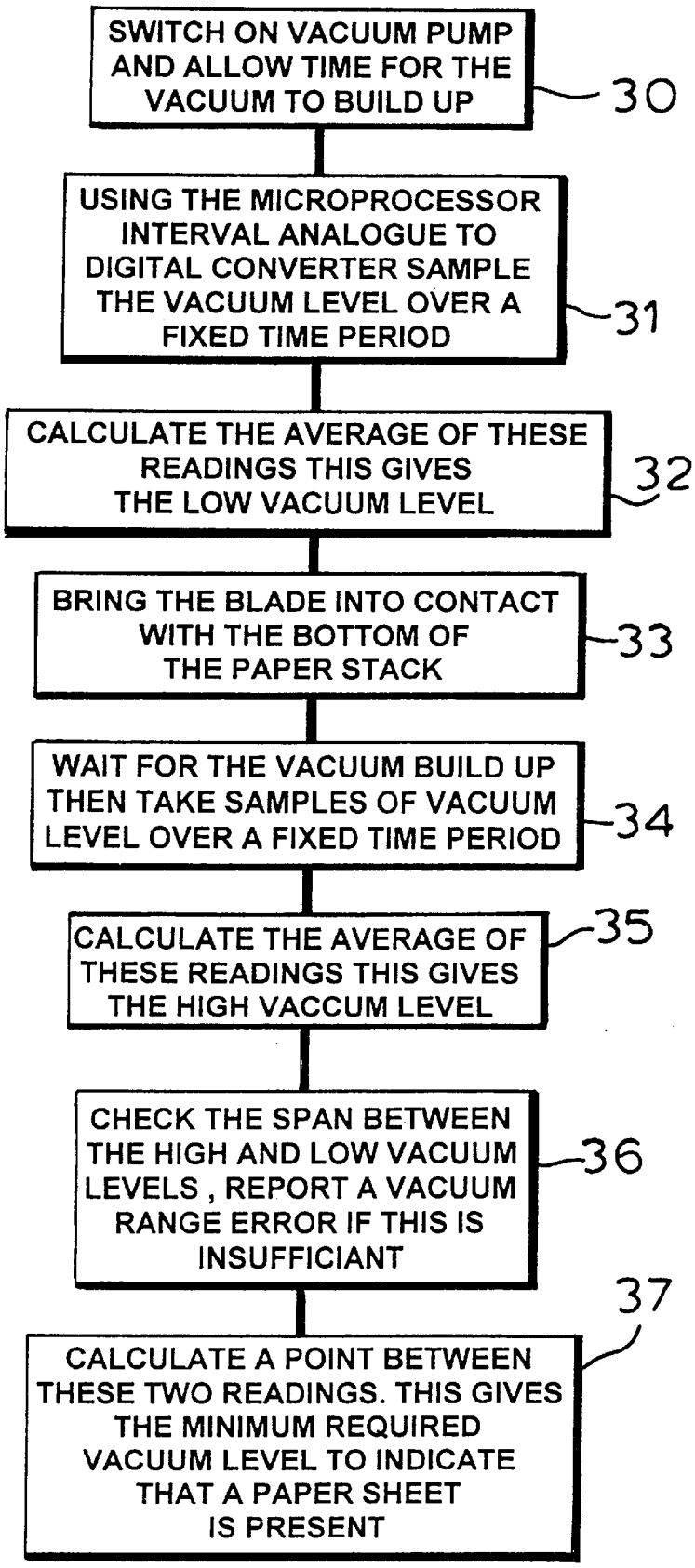
FIG. 3 is a flow chart showing the example of setting-up method of the present invention, for use with the sheet counter of FIGS. 1 and 2.

FIG. 3 is a flow chart showing the setting-up procedure which is to be performed automatically, immediately before a counting operation. Upon an operator instructing the counter to commence the counting of sheets into a stack loaded onto the counter, the micro-processor causes the vacuum pump to start operating (step 30) and suspends other operations for a short predetermined time, in order to allow the pressure to stabilise. Then, for a fixed time period, the signal from the pressure sensor 27 is sampled several times over a fixed time period (step 31), the average of those samples is determined and stored (step 32), this average being the port open pressure or low vacuum level. Typically, 16 samples may be made over 20 ms.

A carrier (not shown) supporting the frame 10 and all the components mounted thereon is then moved to bring the blade 18 into contact with the bottom sheet of the stack of paper to be counted (step 33) and following a further short time delay to allow the pressure to stabilise, further samples of the sensed pressure are taken (step 34) over a fixed time period. A similar number of samples, taken over the same time period, may be performed here as in step 32. Again, the samples are averaged and stored (step 35) in order to obtain a port covered pressure or high vacuum level.

A check (step 36) is then made on the difference between the open and covered pressures and provided that this pressure difference is sufficiently large, then a threshold point between the two pressures is calculated (step 37) in order to set a level at which a sheet is determined as being present on the blade 18 and covering the port 19, for transfer and so counting. In the case of the sheet counter described with reference to FIG. 1, the threshold point is set at approximately midway between the port open pressure and the port covered pressure, but advantageous results are obtained when the threshold is set at substantially 40% of the pressure difference, from the port open pressure. On the other hand, if the pressure difference is not sufficiently large, an error condition is reported in step 36 and no further operation of the counter is permitted until the cause of the low pressure difference is corrected.

Normally, the automatic setting-up procedure described above is carried out at the start of each count cycle, in order to accommodate any system variations. The procedure could however be operated less frequently, especially if the counter is used heavily—for example, it could be used only if the counter has been idle for some pre-set period, with the vacuum pump turned off. Use of the procedure also renders insignificant variations in atmospheric pressure, whether caused by climatic changes or in the physical location of the counter equipment.

As will be appreciated from the foregoing, step 30 may take place only after the completion of step 31, the slightly different value then being obtained in step 32 being accommodated by a suitable adjustment in step 37.

I claim:

1. A method of setting-up a sheet counter before the commencement of a counting operation, which counter includes an element having a suction port over which the sheets to be counted are caused to lie in sequence one after another, a source of sub-atmospheric pressure connected by a duct to the port, and means to sense the pressure within the duct in the vicinity of the port which sensing means provides an electrical signal indicative of sensed pressure, in which method the port is left open and the pressure in the duct is sensed to obtain a first pressure, either before said source is operated to draw air through the port or after operation of said source has commenced; the source is operated and the port in the element is covered whereafter the pressure in the duct is sensed again to obtain a second pressure; and a count pressure value part-way between the first and second pressures is computed, a valid count signal in a subsequent counting operation being generated only if the instantaneous sensed pressure falls below the count pressure value.

2. A method as claimed in claim 1, wherein the pressure in the duct is sampled a predetermined number of times over a pre-set time period, both when the port is open and when the port is covered.

3. A method as claimed in claim 2, wherein the average of the sampled pressures is used in each case as the first and second pressures for the computing of the count pressure value.

4. A method as claimed in claim 1, and including the step of checking the difference between the first and second pressures, and indicating an error condition if the pressure difference is below a predetermined value.

5. A method as claimed in claim 4, wherein further operation of the counter is inhibited if the pressure difference is below said predetermined value.

6. A method as claimed in claim 1 and arranged for the counting of the number of sheets in a stack, wherein the element is positioned adjacent one end of the stack, the first pressure is determined, the element is moved into contact with the end sheet of the stack so as to cover the port, whereafter the second pressure is determined.

7. A method as claimed in claim 6, wherein the sensing of the second pressure is inhibited for a preset period following of the covering of the port.

8. A method as claimed in claim 1, wherein the sensor provides an analogue signal indicative of sensed pressure, the analogue signal is converted to a digital signal, and the processing of the sensed values is performed digitally.

9. A method as claimed in claim 1, wherein the method is performed on an automatic basis immediately before the commencement of a counting operation, each time a counting operation is to be performed.

10. A method as claimed in claim 1, wherein the count pressure value is set at substantially 40% of the difference between the first and second pressures, from the first pressure.

* * * * *